United States Patent [19]

Stroble et al.

[11] Patent Number: 4,878,959

[45] Date of Patent: Nov. 7, 1989

[54] METHOD OF PRODUCING GRAIN-ORIENTED SILICON STEEL WITH SMALL BORON ADDITIONS

[75] Inventors: Carl P. Stroble, Natrona Heights; Anthony P. More, Cheswick, both of Pa.

[73] Assignee: Allegheny Ludlum Corporation, Pittsburgh, Pa.

[21] Appl. No.: 337,593

[22] Filed: Apr. 13, 1989

Related U.S. Application Data

[63] Continuation of Ser. No. 58,078, Jun. 4, 1987, abandoned.

[51] Int. Cl.[4] ..... H01F 1/04

[52] U.S. Cl. ..... 148/111; 148/113

[58] Field of Search ..... 148/111, 113

[56] References Cited

U.S. PATENT DOCUMENTS

| | | | |
|---|---|---|---|
| 3,676,227 | 7/1972 | Matsumoto et al. | 148/111 |
| 3,873,381 | 3/1975 | Jackson | 148/112 |
| 3,905,842 | 9/1975 | Grenoble | 148/111 |
| 3,905,843 | 9/1975 | Fiedler | 148/111 |
| 3,957,546 | 5/1976 | Fiedler | 148/111 |
| 4,000,015 | 12/1976 | Malagari, Jr. | 148/112 |
| 4,054,470 | 10/1977 | Malagari, Jr. | 148/111 |
| 4,054,471 | 10/1977 | Datta | 148/112 |
| 4,078,952 | 3/1978 | Malagari, Jr. | 148/111 |
| 4,244,757 | 1/1981 | Malagari, Jr. et al. | 148/111 |
| 4,338,144 | 7/1982 | Fiedler | 148/113 |
| 4,548,655 | 10/1985 | Miller | 148/111 |
| 4,608,100 | 8/1986 | Malagari, Jr. | 148/111 |
| 4,816,038 | 1/1989 | Maucione | 148/113 |

FOREIGN PATENT DOCUMENTS

| | | | |
|---|---|---|---|
| 1521731 | 8/1978 | United Kingdom . | |
| 2095287 | 9/1982 | United Kingdom | 148/111 |

*Primary Examiner*—John P. Sheehan

*Attorney, Agent, or Firm*—Patrick J. Viccaro

[57] ABSTRACT

A method is provided for producing cube-on-edge grain-oriented silicon steel by producing 3 to 10 ppm boron and a manganese-to-sulfur and/or selenium ratio of at least 2.5 in a final gauge steel strip prior to final texture annealing and including a two-stage cold reduction wherein the final cold reduction is less than 75% to provide a steel having improved magnetic properties with a secondary grain size of less than 10 mm and a permeability of 1850 or more at 10 oersteds.

9 Claims, No Drawings

METHOD OF PRODUCING GRAIN-ORIENTED SILICON STEEL WITH SMALL BORON ADDITIONS

This is a continuation of Application Ser. No. 058,078, filed June 4, 1987, now abandoned.

BACKGROUND OF THE INVENTION

This invention relates to a method of producing conventional grain-oriented silicon steel with improved magnetic properties. More particularly, this invention relates to a method of improving cube-on-edge grain-oriented silicon steel processing by providing small but sufficient amounts of boron in the cold-rolled strip so as to improve magnetic permeability and core loss values.

In the manufacture of grain-oriented silicon steel, it is known that the Goss secondary recrystallization texture, [110][001], in accordance with Miller's Indices, results in improved magnetic properties, particularly permeability and core loss over nonoriented steels. The Goss texture refers to the body-centered cubic lattice comprising the grain or crystal being oriented in the cube-on-edge position. The texture or grain orientation of this type has a cube edge parallel to the rolling direction in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt on the order of 2–4.5% silicon, casting the melt, such as by ingot or continuous casting processes, hot rolling the steel, cold rolling the steel to final gauge with an intermediate annealing when two or more cold-rolling stages are used, decarburizing the steel, applying a refractory oxide base coating, such as magnesium oxide coating, to the steel, and final texture annealing the steel at elevated temperatures in order to produce the desired secondary recrystallization and purification treatment to remove impurities, such as nitrogen and sulfur. The development of the cube-on-edge orientations is dependent upon the mechanism of secondary recrystallization wherein during recrystallization, secondary cube-on-edge oriented grains are preferentially grown at the expense of primary grains having a different and undesirable orientation.

Grain-oriented silicon steel is conventionally used in electrical applications, such as power transformers, distribution transformers, generators, and the like. The silicon content of the steel and electrical applications permit cyclic variation of the applied magnetic field with limited energy loss, which is termed core loss. It is desirable, therefore, in steel of this type, to reduce core loss. It is known that the core loss is made up of two main components, that due to the hysteresis effect, and that due to eddy currents. The magnitude of the eddy currents is also limited by the resistance of the path through which they flow. The resistance of the core material is determined by the resistivity of the material and its thickness or cross-sectional area. Consequently, it is desirable as shown by a trend in the industry that magnetic materials having a high resistivity be produced in thin sheets in order that eddy current losses be kept to a minimum.

Numerous attempts have been made for improving the quality of cube-on-edge grain-oriented electromagnetic silicon steels by the addition of boron to the steel melt. For example, U.S. Pat. No. 3,873,381, issued May 25, 1975, uses boron and nitrogen additions to control grain growth during the primary grain-growth stage in addition to the presence of manganese and sulfur. The reference discloses the need for large amounts of boron on the order of 20 to 120 parts per million (ppm), nitrogen on the order of 3 to 100 ppm in the steel melt. The resulting cold-rolled strip is then subject to special processing including a wet decarburizing atmosphere.

Other attempts to improve magnetic properties include the addition to the silicon-iron melt of a smaller amount of boron to the melt such that the hot-rolled band contains a small but critical amount of boron in critical proportions to the nitrogen content of the metal while controlling the manganese and sulfur to achieve high permeability silicon steels. U.S. Pat. No. 3,905,842, issued Sept. 16, 1975, discloses adding a source of boron to the melt and thereafter processing the melt to provide a cold-rolled sheet containing 5 to 45 ppm boron and from 15 to 95 ppm nitrogen and the proportions of nitrogen and boron being in the ratio of 2 to 4 parts of nitrogen to one part of boron. Sulfur may range from 0.007 to 0.06% and manganese from 0.002 to 0.1%, by weight. The steel of the reference includes at least 0.007% sulfur in solute form during final texture annealing. A similar steel is disclosed in U.S. Pat. No. 3,905,843, issued Sept. 16, 1975, wherein the ratio of nitrogen to boron ranges from 1 to 15 and the ratio of manganese to sulfur is maintained to less than 2.1. The cold-rolling schedules for the processes of both of these references includes an intermediate annealing step between the cold-rolling stages and a final heavy cold reduction on the order of greater than 70%, or 80% or more, to final gauge.

Other attempts have been made to simplify the silicon-iron sheet production process by eliminating one processing step, such as by changing a two-stage cold-rolling operation to a direct cold-rolling process. U.S. Pat. No. 3,957,546, issued May 18, 1976, discloses that when the manganese-to-sulfur ratio is less than 1.8, the hot-rolled band can be cold rolled directly to final thickness without intermediate anneals. An improvement on the direct cold-rolling process is disclosed in U.S. Pat. 4,078,952, issued Mar. 14, 1978. That reference disclosed preparing a band from a melt having 6 to 18 ppm boron and producing a hot-rolled band having a manganese-to-sulfur ratio of at least 1.83 for the purpose of providing uniformity between the poor end and the good end of coils.

Although it is known from the above-cited patents that the quality of electromagnetic silicon steel can be improved by adding controlled amounts of boron to the melt to produce so-called high permeability steels having permeabilities of at least 1870 ($G/O_e$) at 10 oersteds and core loss of no more than 0.700 watts per pound (WPP) at 17 kilogauss, as with most all processes, they are in need of improvement. U.S. Pat. 4,000,015, issued Dec. 28, 1976, discloses a method of controlling the dew point of the hydrogen-bearing atmosphere used to decarburize boron-bearing grain-oriented silicon steels having a cube-on-edge orientation. To such steels, it has also been disclosed in U.S. Pat. No. 4,054,470, issued Oct. 18, 1977, that copper may be present in the steel melt for the purpose of inhibiting primary grain growth. U.S. Pat. No. 4,338,144, issued July 6, 1982, discloses modifying the boron-bearing composition to have less than 20 ppm solute nitrogen and a manganese-to-sulfur ratio of at least 2.1 and thereafter heating the sheet in a nitrogen-bearing hydrogen atmosphere to a temperature sufficient to effect secondary recrystallization. It is also known that large boron levels in silicon steel tend to promote brittleness and reduce the capability of welding the steel. Welding can be an important operation within the process to facilitate processing, increase yield and cut costs of manufacturing production. Although it is preferable to weld hot-rolled band prior to further processing, welding can occur at other stages of production. For example, U.S. Pat. No. 4,244,757, issued Jan. 13, 1981, discloses a method of controlling nitrogen and phosphorus, as both of those elements were found to adversely affect the weldability of the steel.

It is also known that grain-oriented silicon steels containing relatively large amounts of boron result in an increase in the secondary grain size. Typical high permeability silicon steels have grain sizes greater than 10 mm. The eddy current portion of the core loss is directly related to the size of the secondary grains. The larger the grain size, the larger the core loss. Attempts have been made, such as in U.S. Pat. 4,548,655, issued Oct. 22, 1985, to reduce watt loss by achieving fine secondary grain size in boron-bearing silicon steels during final texture annealing. Another manner of reducing core loss values is by reducing the sheet thickness. U.S. Pat. No. 4,608,100, issued Aug. 26, 1986, discloses a method of producing thin gauge oriented silicon steel.

Generally, all of the development work related to the boron-bearing steels in the above-cited patents was done on cube-on-edge grain-oriented silicon steels having a final gauge of about 10 mils or greater. Such steels rely on the high boron content for the primary grain growth inhibition for providing high permeability silicon steels. Such silicon steels also generally undergo cold reduction operations to final gauge wherein a final heavy cold reduction on the order of greater than 80% is made in order to facilitate the grain orientation.

What is needed is a method for producing conventional grain-oriented silicon steel which takes advantage of the benefits of boron additions without the disadvantages thereof. It is desirable that a method be developed for reducing the final gauge of the boron-containing steels to less than nominally 10 mils while maintaining the secondary grain size in the order of conventional grain-oriented silicon steels which do not contain boron. Furthermore, it is desirable to improve the weldability of the steel produced thereby over high permeability steels, such as in U.S. Pat. No. 3,905,842, cited above. The improved process should result in silicon-iron sheet of nominally 10 mils or less characterized by magnetic permeability of at least 1850 ($G/O_e$) at 10 oersteds and improved core loss values over that of conventional grain-oriented silicon steels.

SUMMARY OF THE INVENTION

In accordance with the present invention, a method is provided for producing cube-on-edge grain-oriented silicon steel having improved core loss and magnetic permeability values wherein the method includes making a silicon steel melt composition of about 2 to 4.5% silicon and controlling the manganese and sulfur levels and thereafter producing 3 to 10 ppm boron in a final gauge steel strip prior to final texture annealing. The method includes casting the melt to form a casting thereof, hot rolling the casting to a hot-roll band having a manganese-to-sulfur ratio of greater than 2.5 and cold working the hot-roll band in two stages. The hot-roll band is cold worked to an intermediate gauge strip of about 0.018 to 0.026 inch by a reduction of at least 60%, annealing and thereafter cold working to a final gauge of less than 10 mils by a final cold reduction of about 65% to 75%. The cold-worked final gauge strip is annealed to effect decarburization, a refractory oxide coating is applied, and the final gauge strip having a 3 to 10 ppm boron therein is final texture annealed to develop a permeability of 1850 or more at 10 oersteds with secondary grain sizes of less than 10 millimeters, preferably, with grain sizes comparable to conventional grain-oriented silicon steels.

DETAILED DESCRIPTION OF THE PREFERRED EMBODIMENTS

Broadly, the method of the present invention is directed to producing conventional grain-oriented silicon steel having a cube-on-edge orientation having a modified steel chemistry and modified processing steps.

The manganese, sulfur and/or selenium are necessary as they form the primary grain growth inhibitors which are essential for controlling the steel's orientation and its properties which are dependent thereon. More specifically, the manganese combines with sulfur and/or selenium to form manganese sulfide and/or manganese selenide, as well as other compounds. Together, these compounds inhibit normal grain growth during the final texture anneal, while at the same time aiding in the development of secondary recrystallized grains having the desired cube-on-edge orientation.

It is necessary to the present invention that the ratio of manganese-to-sulfur and/or selenium be at least 2.5 or greater. For that reason, the manganese is kept relatively high within the broad range and sulfur and/or selenium is kept at a relatively low level. As a result of keeping such manganese, sulfur, and selenium levels so as to provide the ratio of at least 2.5 or greater, there are differences in the MnS and/or MnSe solubilities which result in differences in the MnS and/or MnSe precipitation behavior for conventional grain-oriented silicon steel compositions than those of the high permeability compositions set forth in the above-cited patent references. The solubility products also relate to the stability of the inclusions on heating during final texture annealing; the higher the solubility product, the more stable the inclusions of MnS and/or MnSe.

The manganese content of the steel may range up to 0.10% by weight and preferably from a minimum of at least 0.04%. Manganese is necessary to the inhibition system of the steel. More preferably, manganese ranges from 0.068 to 0.085%.

The primary grain growth inhibition system also requires the presence of sulfur and/or selenium. Up to 0.035% of material selected from the group consisting of sulfur and selenium is present, preferably with a minimum of at least 0.016%. More preferably, a low and narrow range of 0.024 to 0.028% is present.

Copper may also be present in the steel up to 0.4% and preferably 0.1 to 0.4%. When copper is present it will combine with manganese and/or sulfur and/or selenium to form various copper compounds, including manganese copper sulfide and/or manganese copper selenide. Together with MnS and/or MnSe inclusions, these compounds inhibit normal grain growth during final texture annealing. As an added copper may also be beneficial during processing, as well as for increasing the steel's resistivity.

The steel melt of the present invention includes up to 0.01% nitrogen, preferably 0.0005% to 0.008%, and more preferably 0.003 to 0.0065% nitrogen; up to 0.08% carbon, preferably 0.028 to 0.04% carbon; and no more than 0.008% aluminum; the balance iron and other incidental impurities and residuals.

The boron content of the steel is essential to the steel in accordance with the present claimed invention. Unlike the prior art processes using relatively large amounts of boron to combine with other elements to act as a primary grain growth inhibitor and to effect secondary recrystallization, the present claimed invention uses manganese to improve magnetic properties of a steel wherein the manganese, sulfur, selenide, and related compounds are the primary grain growth inhibition system with solute boron perhaps providing further inhibition effect, either directly as a solute in the grain boundaries, or by controlling the activity of other elements, perhaps such as nitrogen and solute sulfur.

It is known that residual amounts of boron on the order of up to about 3 ppm may be present in the silicon steel melt. The source of the boron may be from the refractory materials used in the metallurgical vessels, any residual amounts of metal left in the vessels, as well as minor impurities resulting from the sources of the iron and steel used to provide the steel melt. In accordance with the invention; however, the cold-rolled strip must be produced having a boron content of 3 to 10 pm. This may be achieved by adding boron to the silicon steel melt or, alternatively, the boron may be added at some later stage of the processing. The combination of adding boron to the melt and to the annealing separator coating may be used.

The critical aspect in accordance with the invention is that the final gauge strip prior to final texture annealing have a boron content of 3 to 10 ppm, and more preferably a boron content of 3 to 7 ppm. If the boron exceeds 10 ppm, then the advantages of the present claimed invention are negated by the tendency to increase the secondary grain sizes which may result from the boron having more effect in the primary grain growth inhibition system. There will also be a tendency to increase the brittleness and the weldability problems with such higher boron contents. If boron is present of less than 3 ppm, such as in residual levels, it will have little effect to improve the magnetic properties of a conventional grain-oriented steel using a manganese-sulfide and/or selenide inhibition system. If boron is added to the melt, then a sufficient amount of boron should be added in order to produce the desired boron in the final gauge steel strip prior to final texture annealing. Boron should be added to the ladle at appropriate stages in order to minimize any boron loss as a result of refining the steel melt or in any high temperature soaking prior to processing into a hot-roll band. As a practical matter, with proper processing, no significant loss of boron from the metal occurs through hot and cold rolling and heating stages prior to the final texture annealing. Care must be taken, however, to assure that such small amounts of boron, 3 to 10 ppm, as well as a desired manganese-to-sulfur and/or selenium ratio of at least 2.5, is present in the hot-rolled band strip and more preferably in the cold-rolled final gauge strip prior to final texture annealing.

Specific processing up to the steps of cold reduction of the steel and including steps through hot rolled band may be conventional and are not critical to the present invention although it is desirable to minimize any loss of boron if it is added during the melting stage. The steel of the present invention may be processed in a conventional manner by casting, which may be continuous casting or ingot casting, and hot rolling to form hot rolled band. Conventionally the hot rolled band may have a gauge ranging from 0.06 to 0.10 inch (1.52 to 2.54 mm). Typically, the hot rolled band has a gauge of about 0.08 inch (2.03 mm). It is important that the hot rolled band contain the desired manganese-to-sulfur ratio and the required boron content. After annealing the hot rolled band, the process includes an initial cold working of the hot rolled band to an intermediate gauge by a reduction of at least 60% and preferably 60 to 70%. The intermediate gauge steel is then subject to an intermediate anneal which is followed by a second cold working, having a final reduction of less than 75% and preferably less than 70%, more preferably 65 to 70% from intermediate gauge to final gauge of nominally 10 mils or less. The hot-roll band is first cold worked to a desired intermediate gauge of about 0.018 to 0.026 inch (0.46 to 0.66 mm) and preferably from 0.020 to 0.026 inch (0.51 to 0.66 mm). The precise intermediate gauge will depend somewhat on the desired final gauge. A thicker intermediate gauge may be used for the thicker final gauge.

Thereafter, the intermediate gauge steel is subjected to an intermediate anneal before further cold reduction. The purpose of such anneal is to effect a fine grain primary recrystallized structure. The annealing step may be batch or continuous and generally ranges from temperatures of 1700 to 1800° F. (926 to 982° C.) in a protective, nonoxidizing atmosphere, such as nitrogen or hydrogen or mixtures thereof.

After the intermediate annealing, the intermediate gauge is subjected to further cold working and it is important that the final reduction from intermediate to final gauge be about 65% or more and less than 75%, and more preferably less than 70%. Such processing is unique to boron-containing silicon steels for the prior art making of high permeability silicon steels requires a single cold reduction or a final heavy cold reduction in multiple cold reduction processes.

The final gauge material is less than 10 mils, may be as low as 4 mils, and typically may be on the order of a nominal 7 or 9 mils (0.178 to 0.229 mm). The material at final gauge is then decarburized, provided with a refractory oxide base coating, such as magnesium oxide, and final texture annealed, such as in a hydrogen atmosphere, to produce the desired secondary recrystallization and purification treatment to remove impurities, such as nitrogen and sulfur.

In order to better understand the present invention, the following examples are illustrative of several aspects of the invention.

EXAMPLE I

Mill Heat 189002 was prepared having the following melt composition, by weight percent:

| C | Mn | S | Cu | Si | N | B | Fe |
|---|---|---|---|---|---|---|---|
| .030 | .069 | .025 | .15 | 3.25 | .0057 | 7 ppm | Bal. |

The composition was similar to conventional cube-on-edge grain-oriented silicon steel using a sulfide/selenide inhibition system except sufficient boron was added to the melt to achieve 7 ppm boron content. The steel was then conventionally processed through the hot rolled band to a gauge of 0.080 inch (2.03 mm) in the mill. Representative samples of hot rolled band were then processed in the laboratory by cold reduction to a final gauge of nominally 7 mils through the step of final texture annealing. The experiment included variations in intermediate gauge of 0.026 inch, 0.023 inch, 0.020 inch, and 0.018 inch. The analysis of the available data indicated that the intermediate gauge range of 0.023 to 0.020 inch was optimum for the 7-mil finish gauge for that Heat. The anneal of the intermediate cold-rolled gauge and the decarburizing anneal of the cold-rolled final gauge were done in a conventional manner. The annealing separator coating applied to the decarburized strip was a conventional MgO coating containing 5.2% $MgSO_4$. The strip was then final texture annealed in a hydrogen atmosphere to develop the cube-on-edge orientation. Epsteins samples were prepared and the magnetic properties were measured in a conventional manner including core loss in watts per pound at 60 Hertz at 15 and 17 KG, and permeability ($G/O_e$) at 10 oersteds.

TABLE I

| Coil/ Location | Inter. Gauge (Inch) | Lab Processing from Mill Hot-Rolled Band Heat 189002 Core Loss (WPP) @ 15 KG | @ 17 KG | @ 10 H |
|---|---|---|---|---|
| 5/HT | .023 | .444 | .635 | 1887 |
| 5/BT | .023 | .445 | .636 | 1891 |
| 5/HT | .020 | .442 | .636 | 1888 |
| 5/BT | .020 | .426 | .613 | 1891 |

HT means hot top
BT means butt top

The data in Table I illustrate that all samples exhibited good magnetic permeability and core loss when compared to typical conventional grain-oriented silicon steels without the modified chemistry. Typical conventional grain-oriented steel core loss values during that production period were 0.426 WPP at 15 KG and 0.665 WPP at 17 KG and permeability was 1837 at 10 oersteds. The cold-rolled strip prior to final texture annealing contained 7 ppm boron and a manganese-to-sulfur ratio of 2.8. The final texture annealed strip exhibited grain size on the order of 8 mm which is larger than typical 5 mm grain size of conventional grain-oriented silicon steel but substantially smaller than typical high permeability silicon steel grain sizes of 10 mm and larger. The data of Table I clearly shows that additions of small amounts of boron to the steel to provide a small but critical amount of boron in the strip prior to final texture annealing results in higher permeabilities.

EXAMPLE II

The samples of Example I were tested for their response to scribing techniques. Each sample was coated with a stress coating (disclosed in U.S. Pat. No. 4,032,366) and then mechanically scribed using a tool steel stylus to mark substantially parallel lines, about 5 mm apart, and substantially transverse to the rolling direction. All of the Epstein samples showed improvement in core loss values upon scribing as shown in Table II, while maintaining good high permeability values.

TABLE II

| Coil/ Location | Inter. Gauge (inch) | Heat 189002 Core Loss (WPP @ 15 KG | @ 17 KG | μ @ 10 H |
|---|---|---|---|---|
| 5/HT | .023 | .346 | .500 | 1870 |
| 5/BT | .023 | .347 | .504 | 1872 |
| 5/HT | .020 | .340 | .495 | 1869 |
| 5/BT | .020 | .381 | .491 | 1875 |

EXAMPLE III

A total of six mill heats were made having the following ladle composition with the balance being iron:

| Heat No. | Type | C | Mn | S | Cu | Si | N | B |
|---|---|---|---|---|---|---|---|---|
| 1 | Exper. | .030 | .072 | .026 | .27 | 3.28 | .0050 | .0006 |
| 2 | Exper. | .031 | .071 | .026 | .25 | 3.28 | .0054 | .0006 |
| 3 | Exper. | .031 | .076 | .026 | .25 | 3.24 | .0056 | .0007 |
| 4 | Exper. | .029 | .079 | .026 | .21 | 3.26 | .0047 | .0006 |
| 5 | Control | .031 | .071 | .025 | .26 | 3.22 | .0060 | .0002 |
| 6 | Control | .030 | .078 | .026 | .23 | 3.23 | .0043 | .0002 |

An addition of 5 ppm boron was made to the ladle for each of the experimental heats. Each of the above heats was cast into numerous ingots and hot rolled in accordance with Example I. All of the Control Heats and some of the Experimental Heats were cold rolled in accordance with Example I to an intermediate gauge of 0.020 inch. Some of the experimental coils were cold rolled to an intermediate gauge of 0.022 inch. All of the coils were then conventionally annealed and final cold rolled to nominally 7 mils, subjected to a decarburizing anneal and coated with a conventional MgO coating and final texture annealed. The results are shown in the following Table III.

TABLE III

| Heat No. | Inter. Gauge (inch) | Core Loss (WPP) @ 15 KG | @ 17 KG | @ 10 H | Grain Size (mm) |
|---|---|---|---|---|---|
| 1–4 Exper. | .020 | .426 | .663 | 1850 | 7–8 |
| 1–4 Exper. | .022 | .418 | .643 | 1853 | 6–7 |
| 5,6 Control | .020 | .424 | .666 | 1834 | 4–5 |

EXAMPLE IV

Twelve mill heats were melted having a modified conventional grain-oriented chemistry to include boron additions and modified processing to produce 9-mil or 7-mil material. The ladle melt chemistry was as follows:

TABLE IV

| Heat No. | C | Mn | S | Cu | Si | N | B |
|---|---|---|---|---|---|---|---|
| 1 | .031 | .075 | .026 | .21 | 3.27 | .0042 | .0006 |
| 2 | .030 | .078 | .027 | .23 | 3.25 | .0033 | .0005 |
| 3 | .030 | .079 | .026 | .25 | 3.19 | .0040 | .0005 |
| 4 | .028 | .080 | .027 | .20 | 3.23 | .0040 | .0004 |
| 5 | .030 | .073 | .026 | .21 | 3.24 | .0031 | .0006 |
| 6 | .030 | .072 | .026 | .25 | 3.23 | .0046 | .0005 |
| 7 | .030 | .072 | .026 | .25 | 3.23 | .0052 | .0005 |
| 8 | .032 | .073 | .027 | .22 | 3.29 | .0044 | .0006 |
| 9 | .030 | .077 | .025 | .22 | 3.25 | .0038 | .0004 |
| 10 | .032 | .073 | .029 | .24 | 3.23 | .0043 | .0005 |
| 11 | .030 | .076 | .026 | .23 | 3.25 | .0044 | .0003 |
| 12 | .030 | .071 | .025 | .24 | 3.24 | .0043 | .0004 |

The melt chemistries of each of the heats were melted having incidental impurity levels at most containing 0.1% Cr, 0.13% Ni, and 0.015% P and the balance iron. An addition of 3 ppm boron was made to the ladle for each of the heats. Each of the heats was cast into ingot and hot rolled as in Example I. Each of the coils from the heats was cold rolled in two stages with an intermediate anneal. Four of the heats, 1 through 4, were cold rolled to nominally 7 mils from an intermediate gauge of 0.022 inch so that the cold work from intermediate gauge to final gauge was on the order of 68% reduction. Eight of the heats, 5 through 12, were cold rolled to nominally 9-mil final gauge from an intermediate gauge of 0.026 inch having a final reduction of about 67%. Each of the coils were conventionally decarburize annealed, coated with an MgO coating and final texture annealed. Numerous Epstein samples were taken and the average of the good-end and poor-end magnetic properties of each coil strip are set forth in the following Table V.

TABLE V

| No. of Heats | Nominal Gauge | Number of Samples | Avg. G.E. and P.E. Core Loss (WPP) @ 15KG | @ 17KG | Avg. @ 10 H |
|---|---|---|---|---|---|
| 4 | 7 mils | 16 | .391 | .599 | 1854 |
| 8 | 9 mils | 30 | .477 | .619 | 1859 |

When compared to typical average values for 7-mil conventional grain-oriented material of 0.408 WPP at 15 KG and 0.638 WPP at 17 KG and a permeability of 1837 at 10 oersteds, the present claimed invention provides better magnetic properties. When compared to typical average values for 9-mil material at 0.424 WPP at 15 KG and 0.634 WPP at 17 KG and a permeability of 1850 at 10 oersteds, the present claimed invention provides better properties. The typical grain size of the grain-oriented silicon steel processed in accordance with the present invention was about 4 to 5 mm. The boron content in the cold-rolled strip analyzed prior to final texture annealing was about 5 ppm. The manganese-to-sulfur ratio in the strip was about 3.

As was an objective of the present invention, conventional grain-oriented silicon steel using the sulfide primary grain growth inhibition system has been modified through composition and processing to provide improved magnetic properties. The addition of boron has not substantially enlarged the grain size which would adversely affect the core loss values; however, it has resulted in comparable or better core loss and permeability values. The method of the present invention uses the benefits of boron additions without the disadvantages of brittleness problems that are normally associated with boron-containing grain-oriented silicon steels. The process is also useful in thinner gauges of nominally less than 10 mils, on the order of 7 mils, and maybe as low as 4 mils. An advantage of the steel is that it responds well to scribing techniques, unlike conventional grain-oriented silicon steels.

What is claimed is:

1. A method of producing cube-on-edge grain-oriented silicon steel having improved core loss and magnetic permeability values, the method comprising:

making a silicon steel melt composition, by weight percent, of about 2 to 4.5 silicon, up to 0.06 carbon, up to .008 nitrogen, 0.04 to 0.100 manganese, 0.016 to 0.035 of material selected from the group consisting of sulfur and selenium, the balance iron and incidental impurities;

casting the melt to form a casting thereof;

hot rolling the casting at greater than 2300° F. to form a hot-rolled band, said band having a manganese-to-sulphur and/or selenium ratio of greater than 2.5;

cold working the hot-rolled band to an intermediate gauge strip of about 0.018 to 0.026 inch by a reduction of at least 60%;

annealing the intermediate gauge to effect primary recrystallization;

cold working the intermediate annealed gauge steel strip to a final gauge of about 0.0045 to 0.012 inch by a cold reduction of about 65% to 75% the final gauge steel strip having 3 to less than 10 ppm boron therein prior to final texture annealing;

annealing to effect decarburization;

applying to the final gauge steel strip a refractory coating; and final texture annealing the final gauge steel for a time and temperature to develop secondary recrystallization with grain sizes of less than 10 mm and a permeability at 10 oersteds of 1850 or more.

2. The method as set forth in claim 1, wherein making the steel melt composition includes 0.028 to 0.04 carbon, 0.003 to 0.0065 nitrogen, 0.068 to 0.085 manganese, 0.024 to 0.028 of material selected from the group consisting of sulfur and selenium, and a manganese-to-sulfur and/or selenium ratio of 2.5 or more.

3. The method as set forth in claim 1, wherein cold working the intermediate annealed steel strip to final gauge having 3–7 ppm boron therein.

4. The method as set forth in claim 1, wherein cold working the hot-rolled band to an intermediate gauge by a reduction of about 60 to 70%.

5. The method as set forth in claim 1, wherein adding sufficient boron to the melt to produce 3 to less than 10 ppm boron in the final gauge steel strip prior to final texture annealing.

6. The method as set forth in claim 1, wherein the steel composition includes 0.1 to 0.4 copper.

7. The method as set forth in claim 1, wherein cold working the intermediate gauge steel to final gauge by a cold reduction of about 65% to 70%.

8. The method as set forth in claim 1 further including the step of scribing the steel to further improve the core loss values.

9. A method of producing cube-on-edge grain-oriented silicon steel having improved core loss and magnetic permeability values, the method comprising;

making a silicon steel melt composition, by weight percent, of about 2 to 4.5 silicon, 0.028 to 0.04 carbon, 0.003 to 0.0065 nitrogen, 0.068 to 0.085 manganese, 0.024 to 0.028 of material selected from the group consisting of sulfur and selenium, the balance iron and incidental impurities;

adding sufficient boron to the melt to produce 3 to 7 ppm boron in a final gauge steel strip prior to final texture annealing;

casting the melt to form a casting thereof; hot rolling the casting at greater than 2300° F. to form a hot-rolled band, said band having a manganese-to-sulphur and/or selenium ratio of 2.5 or more;

cold working the hot-rolled band to an intermediate gauge strip of about 0.020 to 0.026 inch by a reduction of 60 to 70%;

annealing to effect primary recrystallization;

cold working the intermediate annealed gauge steel strip to a nominal final gauge of 0.007 to 0.009 inch by a cold reduction of 65 to 75%; then annealing to effect decarburization;

applying a refractory oxide coating; and final texture annealing the final gauge steel for a time and temperature to develop secondary recrystallization with grain sizes of less than 10 mm and a permeability at 10 oersteds of 1850 or more.

* * * * *